US006669586B2

(12) United States Patent
Barrie et al.

(10) Patent No.: US 6,669,586 B2
(45) Date of Patent: Dec. 30, 2003

(54) EXPANDING BROADHEAD

(75) Inventors: Bruce Barrie, Waseca, MN (US); John C. Sodaro, Monkton, VT (US)

(73) Assignee: Barrie Archery LLC, Waseca, MN (US)

( * ) Notice: Subject to any disclaimer, the term of this patent is extended or adjusted under 35 U.S.C. 154(b) by 0 days.

(21) Appl. No.: 10/345,118

(22) Filed: Jan. 15, 2003

(65) Prior Publication Data

US 2003/0153417 A1 Aug. 14, 2003

Related U.S. Application Data

(60) Provisional application No. 60/348,538, filed on Jan. 16, 2002.

(51) Int. Cl.[7] ..... F42B 6/08
(52) U.S. Cl. ..... 473/583
(58) Field of Search ..... 473/582, 583, 473/584, 585; 43/6

(56) References Cited

U.S. PATENT DOCUMENTS

| | | | |
|---|---|---|---|
| 2,684,852 | A | 7/1954 | Romeka |
| 2,816,765 | A | 12/1957 | Stockfleth |
| 2,859,970 | A | 11/1958 | Doonan |
| 2,925,278 | A | 2/1960 | Sweetland |
| 2,939,708 | A | 6/1960 | Scheib |
| 2,940,758 | A | 6/1960 | Richter |
| 3,036,395 | A | 5/1962 | Nelson |
| 3,138,383 | A | 6/1964 | McKinzie |
| 3,527,463 | A | 9/1970 | Turner |
| 3,618,948 | A | 11/1971 | McGlocklin |
| 3,672,677 | A | 6/1972 | Moore |
| 3,738,657 | A | 6/1973 | Cox |
| 3,741,542 | A | 6/1973 | Karbo |
| 3,756,600 | A | 9/1973 | Maleski |
| 3,854,723 | A | 12/1974 | Wilson |
| 3,893,866 | A | 7/1975 | Hollingsworth |
| 3,910,579 | A | 10/1975 | Spandel |
| 3,915,455 | A | 10/1975 | Savora |
| 4,006,901 | A | 2/1977 | Simo |
| 4,029,319 | A | 6/1977 | Christen |
| 4,036,499 | A | 7/1977 | Sherwin |
| 4,093,230 | A | 6/1978 | Simo |
| 4,099,720 | A | 7/1978 | Zeren |
| 4,141,554 | A | 2/1979 | Sherwin |
| 4,146,226 | A | 3/1979 | Sorensen |
| 4,203,601 | A | 5/1980 | Simo |
| 4,210,330 | A | 7/1980 | Kosbab |

(List continued on next page.)

*Primary Examiner*—Jacob K. Ackun
(74) *Attorney, Agent, or Firm*—Patterson, Thuente, Skaar & Christensen, P.A.

(57) ABSTRACT

A broadhead being attachable to an arrow shaft, includes a blade support having an internal passage defined in a blade receiving body, the blade receiving body having a plurality of slots defined therein extending from the internal passage to a blade receiving body external margin and having a camming surface. A translatable ring is disposed in the internal passage, and a plurality of extendable blades, each blade being shiftably coupled to the ring proximate a blade first end and being at least partially disposed in a respective slot when in a blade retracted disposition, a blade second end being cammable outward to a blade extended disposition by interaction with the body camming surface. A method of operating an expandable broadhead is further included.

20 Claims, 3 Drawing Sheets

U.S. PATENT DOCUMENTS

| | | | | |
|---|---|---|---|---|
| 4,254,958 | A | | 3/1981 | Bateman, III |
| 4,341,391 | A | | 7/1982 | Anderson |
| 4,381,866 | A | | 5/1983 | Simo |
| 4,405,133 | A | | 9/1983 | Cartwright, Jr. |
| 4,410,184 | A | | 10/1983 | Anderson |
| 4,529,208 | A | | 7/1985 | Simo |
| 4,558,868 | A | | 12/1985 | Musacchia |
| 4,579,348 | A | | 4/1986 | Jones |
| 4,676,512 | A | | 6/1987 | Simo |
| 4,807,889 | A | | 2/1989 | Johnson |
| 4,973,060 | A | | 11/1990 | Herzing |
| 4,986,550 | A | | 1/1991 | Segovia |
| 4,998,738 | A | | 3/1991 | Puckett |
| 5,033,220 | A | | 7/1991 | Phelps |
| 5,066,021 | A | | 11/1991 | DeLucia |
| 5,078,407 | A | | 1/1992 | Carlston et al. |
| 5,082,292 | A | | 1/1992 | Puckett et al. |
| 5,090,709 | A | | 2/1992 | Johnson |
| 5,100,143 | A | | 3/1992 | Puckett |
| 5,102,147 | A | | 4/1992 | Szeluga |
| 5,112,063 | A | | 5/1992 | Puckett |
| 5,172,916 | A | | 12/1992 | Puckett |
| 5,178,398 | A | | 1/1993 | Eddy |
| D342,303 | S | | 12/1993 | Johnson |
| 5,322,297 | A | | 6/1994 | Smith |
| 5,417,440 | A | | 5/1995 | Barrie et al. |
| 5,458,341 | A | | 10/1995 | Forrest et al. |
| 5,472,213 | A | | 12/1995 | Dudley |
| D370,246 | S | | 5/1996 | Johnson |
| 5,564,713 | A | | 10/1996 | Mizek et al. |
| 5,803,844 | A | | 9/1998 | Anderson |
| 5,820,498 | A | | 10/1998 | Maleski |
| 5,857,930 | A | | 1/1999 | Troncoso |
| 5,879,252 | A | | 3/1999 | Johnson |
| 5,931,751 | A | * | 8/1999 | Cooper ..... 473/583 |
| 5,941,784 | A | | 8/1999 | Mizek |
| 6,015,357 | A | | 1/2000 | Rizza |
| 6,077,179 | A | | 6/2000 | Liechty, II |
| 6,200,237 | B1 | | 3/2001 | Barrie |
| 6,258,000 | B1 | | 7/2001 | Liechty, II |
| 6,270,435 | B1 | * | 8/2001 | Sodaro ..... 473/583 |
| 6,283,880 | B1 | | 9/2001 | Barrie |
| 6,517,454 | B2 | | 2/2003 | Barrie et al. |
| 6,554,727 | B1 | * | 4/2003 | Armstrong et al. ..... 473/584 |

* cited by examiner

EXPANDING BROADHEAD

RELATED APPLICATIONS

The present application claims the benefit of U.S. Provisional Patent Application No. 60/348,538, filed Jan. 16, 2002 and incorporated herein by reference.

TECHNICAL FIELD

The present invention relates to an arrowhead and more particularly to a broadhead with extendable/retractable blades.

BACKGROUND OF THE INVENTION

In the past, various blade extending broadhead arrow tips have been provided and various mechanical arrangements to achieve the radial shifting of the blades affords the change from a compressed, in-flight, blade position to the expanded, wound enlarging position and are found in the prior art. The broadhead of U.S. Pat. No. 6,270,435 (owned by the present assignee) typifies such art.

In the past, various blade extending broadhead arrow tips have been provided and various mechanical arrangements to achieve the radial shifting of the blades affords the change from a compressed, in-flight, blade position to the expanded, wound enlarging position and are found in the prior art. Applicants, however, are not aware of any such broadhead which does not include mechanical shifting elements to arrive at the blade position change.

SUMMARY OF THE INVENTION

The present invention is a new expanding broadhead having ring mounted blades with a selected number of blades commonly mounted on a single or multiple ring which ring moves longitudinally internally of the body of the broadhead and the blades move from an in-flight, compressed position to a hide or flesh cutting, outwardly extending position upon striking a target to enlarge the entrance opening into an animal.

The blades of the broadhead are rotatably mounted to a longitudinally moving ring member which is arranged within a longitudinally extending cavity within the body of the broadhead and, further, may be arranged within longitudinally extending slots in the body to allow for a compressed, in-flight position which blades are cammed outwardly from such slots upon the broadhead striking an object. A portion of the blade carrying body or other member affixed to the body at the rear of the slots provides the camming action to the blades.

With the arrangement provided herein, the rearward and resulting radial shifting of the blades results from the entry of the broadhead into the object upon contact. The common ring mounting of the blades insures simultaneous movement of the blades.

The present invention is a broadhead being attachable to an arrow shaft, including a blade support having an internal passage defined in a blade receiving body, the blade receiving body having a plurality of slots defined therein extending from the internal passage to a blade receiving body external margin and having a camming surface. A translatable ring is disposed in the internal passage, and a plurality of extendable blades, each blade being shiftably coupled to the ring proximate a blade first end and being at least partially disposed in a respective slot when in a blade retracted disposition, a blade second end being cammable outward to a blade extended disposition by interaction with the body camming surface. A method of operating an expandable broadhead is further included.

DETAILED DESCRIPTION OF THE DRAWINGS

Figure 1:
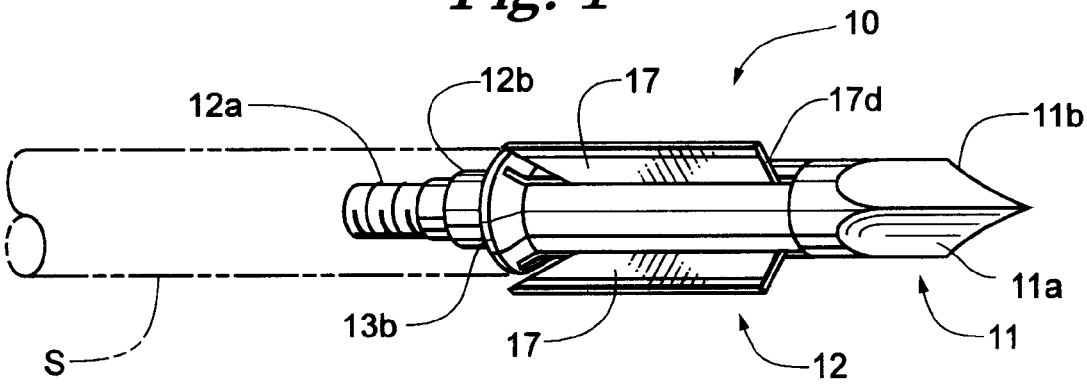
FIG. 1 is a side elevation of the expanding broadhead embodying the concepts of the applicants' invention in its compressed, in-flight position.

In accordance with the accompanying drawings, applicants' broadhead 10 includes a penetrating tip 11 and a blade support 12. The broadhead 10, including blade support 12 and tip 11 is secured to an arrow shaft S by threaded 12*a* and shouldered 12*b* longitudinal, rearwardly directed extensions.

Tip 11 provides a longitudinally extending body having internal threads on the rearmost end thereof, not shown, with the opposite end of the same being faceted to provide a penetrating end consisting of a plurality of cutting surfaces and edges 11*a*, 11*b*. Although the applicants have elected to illustrate four (4) such surfaces 11*a* and edges 11*b* and though the broadhead body 11 illustrated includes three (3) expanding blades and therefore does not reflect this concept, the number of such surfaces 11*a* and edges 11*b* will normally correspond to the number of blades provided on the broadhead blade support 12. The number of blades is selectively chosen and may include up to, for example, eight (8). Applicants' design will work equally well with various selections.

Blade support 12 includes a longitudinally extending generally cylindrical blade receiving body 13 having a front, threaded tip receiving section 13*a* connectable with tip 11 and a rear blade camming section 13*b* having a camming surface 13*c*. A longitudinally extending, generally cylindrical internal passage 14 is provided within said blade support 12 and terminates in spaced relation from the threaded front 13*a* and extensions 12*a*, 12*b*.

A plurality of longitudinal grooves 15 are formed in said blade receiving body 13 and may extend the entire longitudinal dimension of internal passage 14. The grooves 15 extend from the internal passage 14 to the external margin of the blade receiving body 13.

The illustrated blade mounting ring 16 (see FIGS. 3 and 4) is designed for ease of placement on and removal of blades 17 and is provided to slide freely within said passage 14. The ring 16 has a hinge point 16*a* corresponding to each of the blades 17. The hinge points 16*a* are preferably equiangular displaced around the ring 16.

A plurality of blades, each designated 17, is mounted onto ring 16 for free rotation thereon with a mounting passage 17*a* being hingeably coupled to a respective hinge point 16*a*. Each of the blades 17 includes a longitudinally extending body having an inner edge 17*b*, a sharpened outer edge 17*c*, a forward end 17*d*, and a rearward end 17*e* and is of a thickness to be received into and allow movement of the blades within slots 15 of blade receiving body 13.

Figure 2:
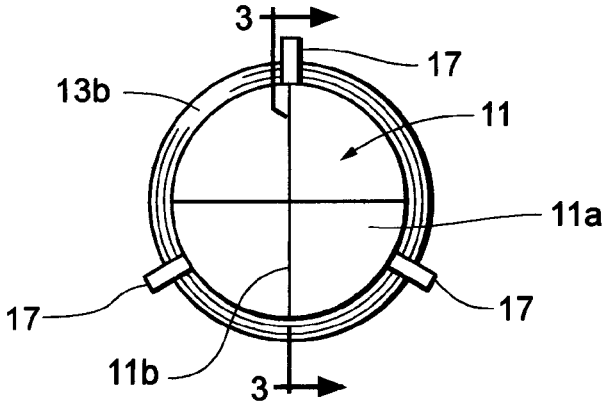
FIG. 2 is a front view thereof.
Figure 4:
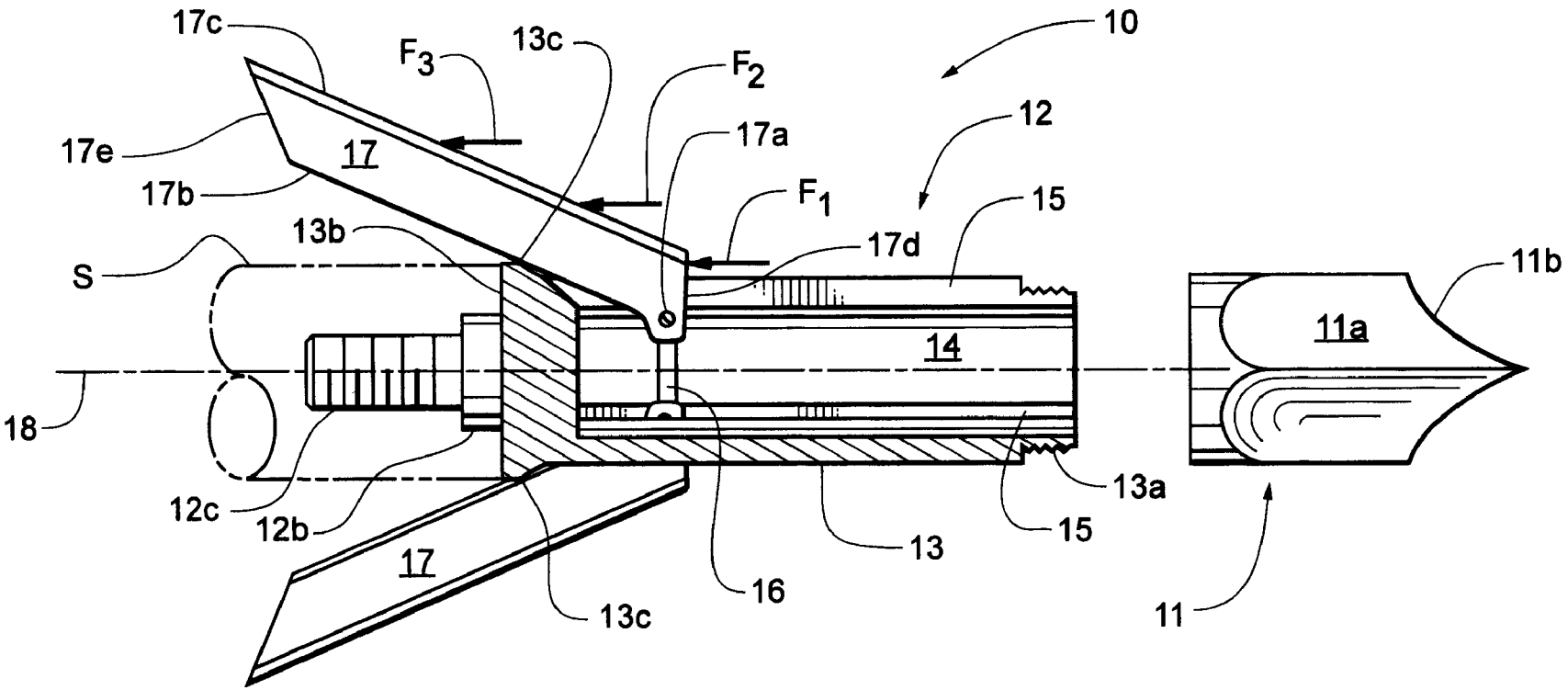
FIG. 4 is a longitudinal section similar to that of FIG. 3 but illustrating the broadhead in a partially, blade expanded position.

The width of the blades 17 provides that the blades 17 will extend radially outwardly of the blade support 12 during what is termed an in-flight or retracted position as best shown in FIGS. 1 and 2. In this position, the sharpened outer edge 17*c* is exposed and is generally parallel to the longitudinal axis 18. The width of the blades 17 also provides that the forward ends 17*d* thereof are exposed in the retracted disposition will impact with an object struck by the broadhead 10 to drive the ring-blade assembly 16, 17 rearward to react against the end of slots 15 and camming area 13*b*, the blades 17 being driven outwardly to an extended, entrance aperture enlarging position, as depicted in FIG. 4. During the in-flight or retracted position, the inner edges 17*b* of the blades 17 may be within slots 15. The rearward end 17*e* of blades 17 may be, as shown, angularly arranged with respect to the inner 17*b*, and outer 17*c* edges of the blades 17 such that camming motion for blade expansion is easily initiated upon rearward movement of the ring-blade 16,17 assembly.

Such camming motion is initiated by the blade leading edge 17*d* striking an object at high speed. Resistance of the object to penetration by the broadhead 10 drives the ring 16 and all the blades 17 rearward (leftward in FIGS. 3 and 4). This motion drives the blade rearward end 17*e* against the camming surface 13*c* and shifts the blades 17 from the retracted disposition (FIG. 3) to the extended disposition (FIG. 4). The blades 17 extend radially outward by the camming action of the interaction of the blade rearward end 17*e* and the camming surface 13*c*. Impact of a single blade 17 with an object will result in extension of all the blades 17 since all the blades 17 are joined to the common ring 16.

When in the extended disposition, the camming surface 13*c* supports the blade inner edge 17*b*. The blades 17 are caused to stay in the extended disposition during passage of the broadhead 10 through an object as result of the force F1 (see FIG. 4) generated on the leading edge 17*d* and the transverse component of the force F2 generated on the portion of the blade 17 forward of the point of contact with the camming surface 13*c* being greater than the transverse component of the force F3 generated on the portion of the blade 17 rearward of the point of contact with the camming surface 13*c*.

Figure 3:
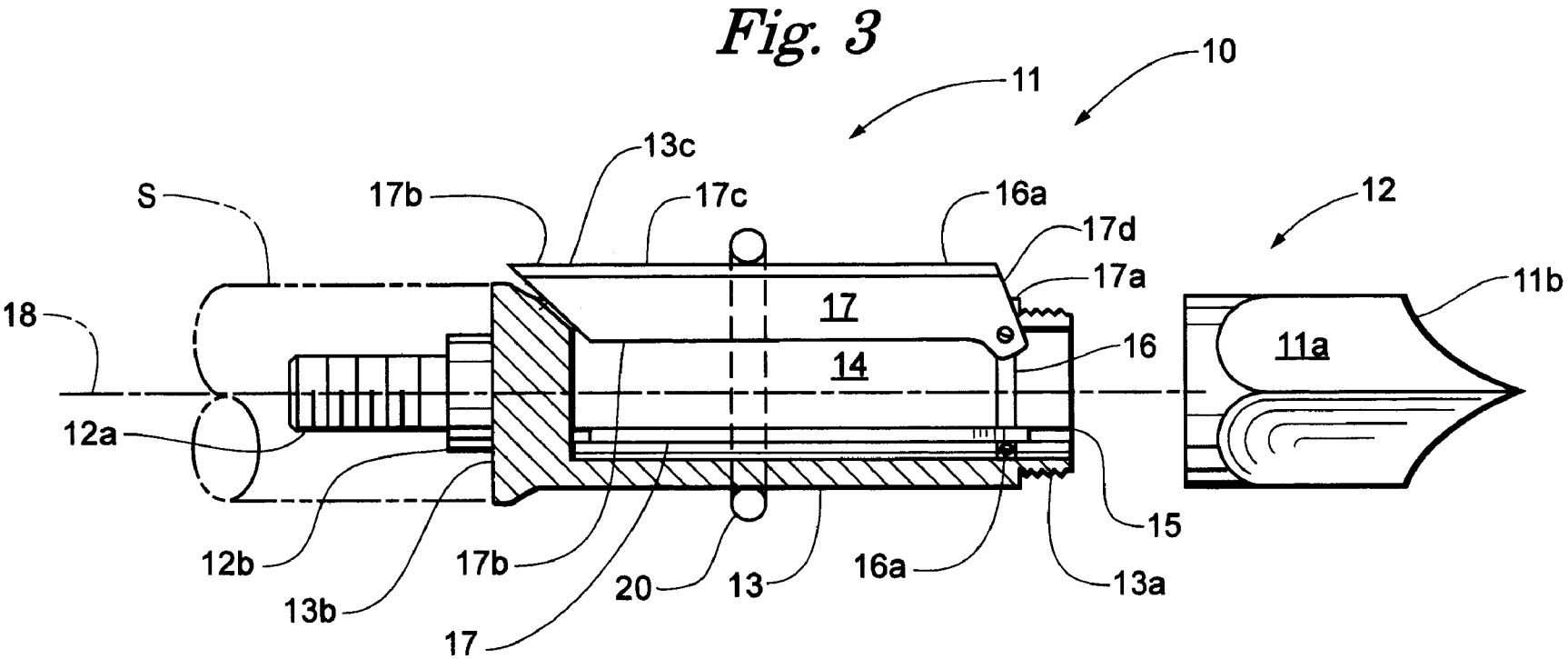
FIG. 3 is a longitudinal section taken substantially along Line 3—3 of FIG. 2 in which the tip of the broadhead is separated from the body of the broadhead for illustrative purposes.

As depicted in FIG. 3, a retaining member 20, either cutable or rearwardly displaceable may be provided about the blades 17 to, at least during a portion of the retracted in-flight position, maintain said blades 17 in such position. Such a member 20 would be cut by outward expansion of the blades or simply moved by target contact. Such a member 20 could be, for example, an O-ring or a rubber band.

To assemble the broadhead 10, the blades 17 are first coupled to the ring 16 at the respective hinge points 16*a* to form a ring/blade assembly 16, 17. The ring/blade assembly 16, 17 is arranged within passage 14 with the blades 17 arranged in slots 15. The tip 11 is then threadedly attached to the blade support 12. With the ring/blade assembly 16, 17 in its forwardmost, in-flight, retracted position, the arrow S is ready for shooting. During flight, with or without the mentioned retainer 20, the blades 17 will remain in slots 15 or in close proximity to the blade support 12, and upon striking and penetrating an object, a rearward force (forces F1, F2, and F3) is directed to the blades 17, causing the ring-blade 16–17 assembly to move rearwardly, camming the blades 17 into extended position.

To reverse this process, the blades 17 will either be radially, inwardly moved to cause forward motion or forwardly moved allowing radial shifting to return to the in-flight, retracted position for a subsequent shooting. In either manner, it is not essential to disassemble the tip 11 from the blade support 12. It should be noted, however, that the ring/blade assembly 16, 17 structure allows for removal and replacement of such assembly 16, 17 should one or several of the blades 17 become dull or broken. This is a definite advantage to a hunter as the hunter is not required to remove the broadhead 10 from the arrow shaft S for such repair.

The applicants have provided a new and unique, expanding broadhead that relies only upon successful hunting use to activate its intended use. That is to say that the shooting of the broadhead into an object results in the expanding of the blades to effect the desired, entrance opening enlargement for generation of an expanded channel in the object.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A broadhead being attachable to an arrow shaft, comprising;

a blade support having an internal passage defined in a blade receiving body, the blade receiving body having a plurality of slots defined therein extending from the internal passage to a blade receiving body external margin and having a camming surface;

a translatable ring disposed in the internal passage; and a plurality of extendable blades, each blade being shiftably coupled to the ring proximate a blade first end and being at least partially disposed in a respective slot when in a blade retracted disposition, a blade second end being cammable outward to a blade extended disposition by interaction with the body camming surface.

2. The broadhead of claim 1, each blade having a blade leading edge disposed proximate the blade first end, the blade leading edge being exposed when the blade is in the retracted disposition.

3. The broadhead of claim 2, the blade leading edge being strikeable with an object, the impact of such striking acting to force the blade second end into interaction with the body camming surface for camming the blade outward into the extended disposition.

4. The broadhead of claim 2 wherein a force imposed on the leading edge of a blade acts to force the blade second end of all blades into interaction with the body camming surface for camming all the blades outward into the extended disposition.

5. The broadhead of claim 1, a blade inner edge being supported by the camming surface when the blade is in the extended disposition.

6. The broadhead of claim 1 wherein an assembly comprising the plurality of blades coupled to the ring is retained in the internal passage by a tip, the tip being in threaded engagement with the blade support.

7. The broadhead of claim 1 wherein the blades are retained in the retracted disposition by a circumferential retaining member.

8. The broadhead of claim 1 wherein the blades are retained in the retracted disposition by a circumferential retaining member that is severable by the blades during shifting of the blades from the retracted disposition to the extended disposition.

9. The broadhead of claim 1 wherein the blades are retained in the extended disposition by a force exerted on the blades by passage of the blades through an object.

10. The broadhead of claim 9 wherein the blades are retained in the extended disposition by a force exerted on the blades during passage through an object, a first portion of the force exerted on a blade leading edge and on a first portion of a blade cutting edge being greater than a second portion of the force exerted on a second portion of a blade cutting edge.

11. A method of operating an expandable broadhead, comprising:

defining an internal passage in a blade receiving body of a blade support, defining in the blade receiving body a plurality of slots extending from the internal passage to a blade receiving body external margin and forming a body camming surface;

translatably disposing a ring in the internal passage; and shiftably coupling each blade of a plurality of extendable blades to the ring proximate a blade first end and at least partially disposing each blade in a respective slot when in a blade retracted disposition and camming outward a blade second end to a blade extended disposition by blade second end interaction with the body camming surface.

12. The method of claim 11, forming a blade leading edge on each blade proximate the blade first end, exposing the blade leading edge when the blade is in the retracted disposition.

13. The method of claim 12, striking the blade leading edge with an object, forcing the blade second end into interaction with the body camming surface by the impact of such striking, and camming the blade outward into the extended disposition.

14. The method of claim 12, imposing a force on the leading edge of a blade acts to force the blade second end of all blades into interaction with the body camming surface and camming all the blades outward into the extended disposition.

15. The method of claim 11, supporting a blade inner edge by the camming surface when the blade is in the extended disposition.

16. The method of claim 11 retaining an assembly comprising the plurality of blades coupled to the ring in the internal passage by a tip and threadedly engaging the tip with the blade support.

17. The method of claim 11, including retaining the blades in the retracted disposition by a circumferential retaining member.

18. The method of claim 11 including retaining the blades in the retracted disposition by a circumferential retaining member and severing the circumferential retaining member by the blades during shifting of the blades from the retracted disposition to the extended disposition.

19. The method of claim 11 including retaining the blades in the extended disposition by a force exerted on the blades as a result of passage of the blades through an object.

20. The method of claim 19 including exerting a portion of the force on a blade leading edge and on a first portion of a blade cutting edge that is greater than a portion of the force exerted on a second portion of a blade cutting edge.

* * * * *